United States Patent [19]

Didier et al.

[11] Patent Number: 4,758,175

[45] Date of Patent: Jul. 19, 1988

[54] AIRCRAFT GROUND POWER CABLE

[75] Inventors: Robert G. Didier, Santa Rosa; Michael L. Price, St. Helena, both of Calif.

[73] Assignee: BIW Cable Systems, Inc., Boston, Mass.

[21] Appl. No.: 911,865

[22] Filed: Sep. 26, 1986

[51] Int. Cl.[4] ..... H01R 13/52

[52] U.S. Cl. ..... 439/281; 439/805; 439/651; 439/588

[58] Field of Search ..... 339/92, 263 R, 94, 60, 339/154–157, 268, 147 R, 147 P, 31, 32, 28, 29, 153, 166; 200/5 R, 5 E, 5 A, 281, DIG. 2

[56] References Cited

U.S. PATENT DOCUMENTS

| | | | |
|---|---|---|---|
| 2,015,590 | 9/1935 | Cavanagh et al. | 339/60 R |
| 2,190,363 | 2/1940 | Knapp | 339/268 R |
| 2,869,091 | 1/1959 | Robards | 339/268 R |
| 4,199,653 | 4/1980 | Talley | 174/15 WF |
| 4,402,566 | 9/1983 | Powell et al. | 339/94 M |
| 4,609,247 | 9/1986 | Annoot | 439/272 |
| 4,639,054 | 1/1987 | Kersbergen | 339/147 R |

OTHER PUBLICATIONS

Catalog of Burton Electrical Engineering Co., 111 Maryland Street, El Segundo, Calif., page relating to Burton Series 1700 Cable Assemblies.

*Primary Examiner*—David Pirlot
*Attorney, Agent, or Firm*—Kenway & Crowley

[57] ABSTRACT

An aircraft ground power cable system having field-replaceable nose and contact components. The connector body is at one end integrally molded to a ground cable sheath and at the other end is provided with internal fixed contacts to which a replaceable nose section may be threadably secured. Weather- and water-tight seals are provided about the peripheral junction of the nose section and the connector body as well as about the sealing screws which secure the nose to the body. Also provided on the connector body in sealed relationship are a replaceable switch plate and switches mounted on that plate. The replaceable nose section includes replacement contacts for engaging mating contacts on the aircraft.

4 Claims, 1 Drawing Sheet

AIRCRAFT GROUND POWER CABLE

This invention relates in general to power cables and in particular to aircraft ground power cables having field-replaceable contact members and connector nose components.

BACKGROUND OF THE INVENTION

It is frequently necessary or desirable to deliver power from a source to aircraft which are at terminal parking positions, in a hangar, or in repair shops or test facilities. Most aircraft are equipped with power input connectors which commonly consist of a male plug recessed for protective purposes in a socket. A suitable female connector head to which a cable from the power source is attached is plugged into the socket when power is needed in the aircraft. Inevitably, the power cable and connector head are subjected to considerable abuse from dragging abrasion or falls against concrete or asphalt surfaces, as well as exposure to petroleum products and weather conditions.

Power delivery systems currently in use often include multiple single conductors banded together at spaced points and individually connected to contact members in the connector head. Such banded conductor assemblies are heavy and cumbersome and require manual wrapping and coiling at the gateway or at the power supply vehicle because they do not lend themselves to proper coiling on a take-up reel. Also, these 5 early connectors lacked any switching capabilities which meant that they had to be plugged into the planes "live" or, after plugging in, the operator had to walk to the power source where switches were located to turn on power. The absence of switches at the connector head end, further made it impractical to enjoy the convenience and saving of labor that may be had with powered cable reels.

Finally, connector contact members tend to lose their gripping force with use and the passage of time. Ultimately, the weight of the cable and the diminished cable gripping forces combine to cause the connectors to drop out of the aircraft sockets and to fall to the hard surfaces below causing loss of power as well as damage to the connector nose area. Necessary repairs or replacements could be made usually only by the installation of entirely new equipment, field repair not being feasible.

SUMMARY OF THE INVENTION

A general object of the present invention is the improvement of aircraft ground power cable and connector systems.

A further object of the invention is an aircraft ground power connector in which the most vulnerable components are easily replaced in the field.

A still further object is to make available at the power connector head switches for controlling the flow of power to an aircraft and for accessory purposes such as reeling the power cable in or out.

Another object of the invention is the provision of a round flexible cable enclosing conductors in a single sheath, which is easily adapted to coiling and uncoiling on a powered reel.

Yet another object is to make replaceable in the field not only the switches, but, more important, the contacts and the end or nose of the connector head or body which is most subject to damage.

These and other objects, features and advantages are achieved in the present invention by constructing the connector head or body out of two mating sections which are joined in water-and-weatherproof fashion. The rear section of the body is integrally molded to a rounded cable jacket which encloses and sheaths all conductors. The front contact or nose section is joined to the rear section by removable sealing screws and the peripheral junction of the sections includes an outer flexible rubber lip seal. The nose section can be easily and quickly replaced with a new nose section which will be joined with the same environmental seals to the rear connector body that existed with the old nose section. The nose section also includes replacement power contacts which restore and renew the gripping forces operative to hold the connector plug in place in the aircraft power socket.

Switches, not only for basic power but also for accessory purposes such as controlling a power reel to advance or retract the power cable are mounted in sealed relationship upon a switch plate which also is sealed in place, but is replaceable by the removal of screws holding the plate, in the connector body.

For a better understanding of the present invention together with its other features and advantages, reference should be made to the description below of a preferred embodiment which is shown in the appended drawing in which:

FIGS. 1 and 1A are a front view partly in section and limited to a short length of cable and a connector head or body; and FIG. 2 is a partial top view of the connector of FIG. 1.

DESCRIPTION OF PREFERRED EMBODIMENT

Figure 1:
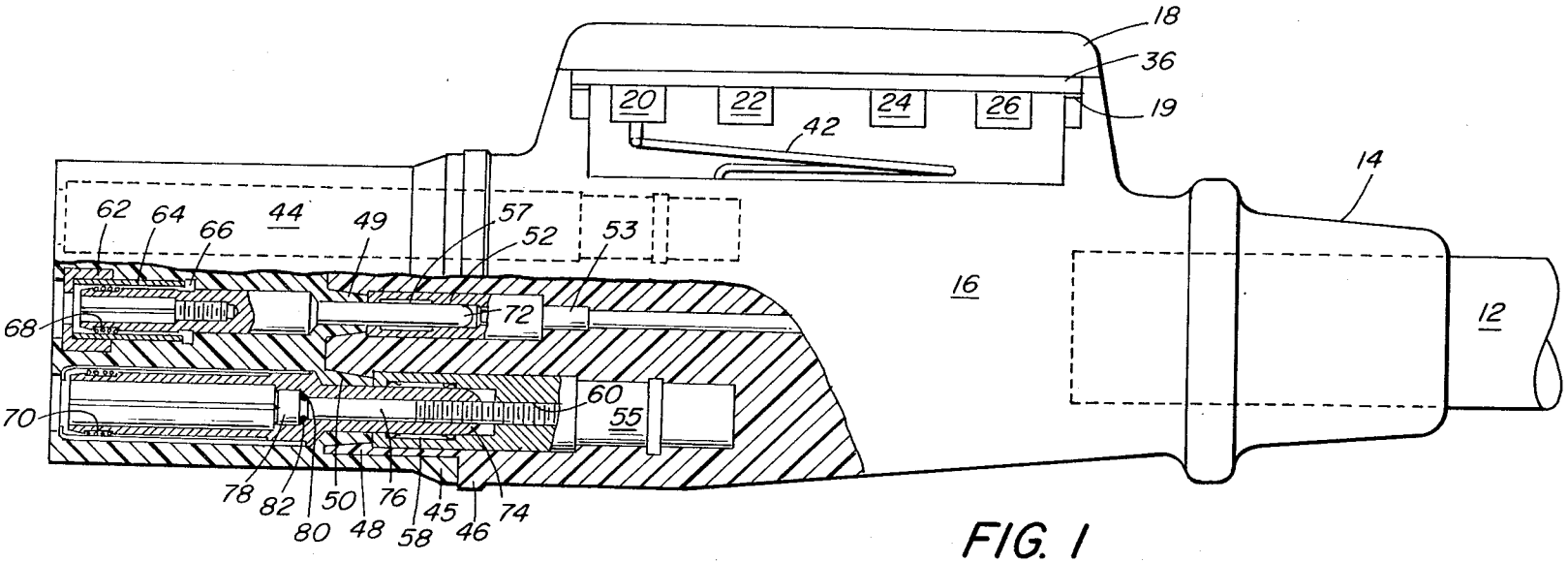
Figure 2:
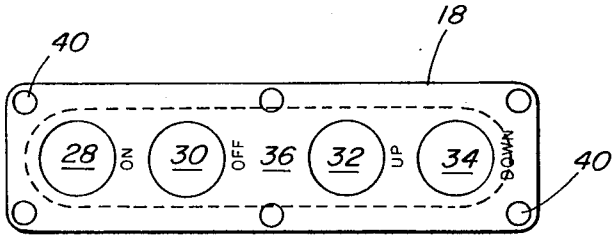
Figure 1A:
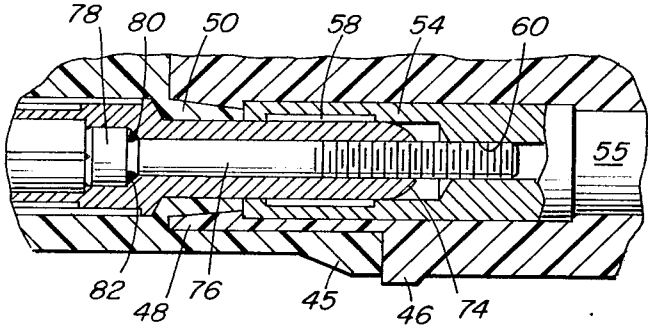

At the right of FIG. 1, a cable 12 is fragmentarily shown. The cable 12 may include a number of conductors within a single sheath. For example, there may be as many as six power conductors, a ground or neutral conductor and as many control conductors as are desired to actuate accessories such as a power reel. The cable is preferably round in cross-section and the sheath is made of rubber or other flexible rubber-like material. Integrally molded over the cable 12 is a tapered transition section 14 which forms the back end of a connector body 16.

Also integrally molded as a part of the connector head 16 is a box-like switch enclosure 18. The switch enclosure 18 has an open top through which access may be had to the terminals 20–26 of switches 28–34. The switches 28–34 may be mounted in a flat cover plate 36 under which there is a thin generally rectangular rubber gasket 19. The gasket 19 serves to hold the cover plate 36 in weather-tight relationship to the top of the enclosure 18 by means of set screws 40 which pass through the plate 36 and the gasket 19 to compress the gasket and effect a seal. Each of the switches 28–34 is similarly sealed by means of rubber covers in the cover plate 36.

A typical conductor 42 from the cable 12 is shown connected to the terminal 20, sufficient slack being provided in the conductor to permit easy removal of the cover plate 36 from the enclosure 18 without breaking connections to the various switch terminals.

Joined to the connector head 16 is a detachable nose section 44. The nose section 44 has peripheral extension 45 which abuts a flange 46 of the head 16 at its periphery and inward of the periphery, the connector head 16 is provided with a lip 48. The lip 48 consists of a tapered extension which fits into a groove formed in the nose section 44 and over which the extension 45 is tightly fitted in place.

In addition to the peripheral extension 45, the nose section 44 is also provided with sealin9 cones of rubber or rubber-like material of which the cones 49 and 50 are typical. These cones fit into correspondingly tapered openings in the connector head 16. Retained in passages in the connector head are fixed female spring contacts such those shown at 52 and 54. Each such contact is connected to a conductor as at 53 and 55 which conductors are in turn connected either to switches in the enclosure 18 or run directly to the cable 12.

The contacts 52 and 54 include metallic spring-loaded receptors 57 and 58 and each further includes a threaded smaller opening such as that at 60.

At the extremity of the nose section 44, detail on the replaceable contacts is shown. Each includes a mounting insulator as at 62, a shield as at 64 and a bushing as at 66. Retained within each such assembly are spring contacts as at 68 and 70. The spring contacts 68 and 70 have rounded plug heads as at 72 and 74 which are engaged by the fixed contacts 52 and 54 respectively. Axial openings are formed in the plug heads such as 74 to accommodate sealing screws as at 76. The typical sealing screw 76 which is shown has a head 78 bearing upon an O-ring seal 80 which is compressed against a shoulder 82 formed in the spring contact 70.

Each sealing screw is detachably threaded into a corresponding opening to retain the nose section in place. The number of screws used may be varied as needed, but each such screw passes through a hollow contact member of the nose section 44 and is screwed into an opening in the connector head 16. Each such screw is provided with an O-ring seal as shown at 80 and each such contact is surrounded by a sealing cone a at 49 and at 50. The entire nose section is of course further sealed in place on the connector head by the peripheral lip seal 45,48. Thus, when replacement is required, relatively unskilled personnel in the field can replace a complete nose and contact assembly by the removal and replacement of a few screws.

What is claimed is:

1. A ground cable connector system for detachably connecting an aircraft having input power terminals to a power source comprising a cable which includes a plurality of conductors enclosed in a sheath, a connector body molded in weather-tight relationship to said sheath, said connector body including a detachable nose section, a plurality of generally tubular contacts disposed in said nose section and arranged for plug-and-socket connection to said aircraft input power terminals, a second plurality of fixed contacts connected to conductors of said cable and disposed in said connector body, certain of said fixed contacts being electrically connectable to corresponding ones of said contacts in said nose section, and set screws passing through said tubular shaped contacts for detachably securing said nose section to said connector body in weather-tight relationship thereto.

2. A ground cable connector system as defined in claim 1 including a power reel for advancing and retracting said cable and a switch connected between a source of power and said power reel to control the operation thereof.

3. A ground cable connector system as defined in claim 1 wherein said tubular contacts have shoulders formed therein, said set screws have enlarged heads and 0-ring gaskets are disposed between said shoulders and said enlarged heads.

4. A ground cable connector system as defined in claim 2 including a removable plate and gasket fixed in said connector body, said switche being mounted in said plate.

* * * * *